United States Patent [19]

Kinoshita

[11] Patent Number: 4,800,343

[45] Date of Patent: Jan. 24, 1989

[54] DC CUTTING CIRCUIT

[75] Inventor: Humiaki Kinoshita, Nagaokakyo, Japan

[73] Assignee: Murata Manufacturing Co., Ltd., Japan

[21] Appl. No.: 47,196

[22] Filed: May 7, 1987

[30] Foreign Application Priority Data

May 9, 1986 [JP] Japan ..... 61-106998

[51] Int. Cl.[4] ..... H01P 1/20; H01P 5/02

[52] U.S. Cl. ..... 333/24 C; 333/204; 333/246

[58] Field of Search ..... 333/104, 24 C, 204, 333/205, 246, 247

[56] References Cited

U.S. PATENT DOCUMENTS 4,157,517 6/1979 Kneisel et al. .

4,334,202 6/1982 Cornish et al. ..... 333/246 X 4,560,964 12/1985 Meier ..... 333/204 X

FOREIGN PATENT DOCUMENTS 229501 11/1985 Japan ..... 333/204

*Primary Examiner*—Paul Gensler

*Attorney, Agent, or Firm*—Ostrolenk, Faber, Gerb & Soffen

[57] ABSTRACT

A DC cutting circuit for passing a signal having a selected wavelength from input side circuitry to output side circuitry while cutting from said signal any DC component therein, which includes a resonator electrode having an electrical length of $\frac{1}{4}$ wavelength and formed at a forward open end of a strip line connected to an input side circuitry, and another resonator electrode also having an electrical length of $\frac{1}{4}$ wavelength and formed at a forward open end of a strip line connected to an output side circuitry, with said resonator electrodes being disposed in a parallel spaced relation to each other so as to couple the input side circuitry with the output side circuitry by the two resonator electrodes.

4 Claims, 1 Drawing Sheet

DC CUTTING CIRCUIT

BACKGROUND OF THE INVENTION

The present invention generally relates to electrical circuitry and more particularly, to a circuit for cutting or removing a direct current component or DC component (referred to as a DC cutting circuit hereinafter) suitable for use in an output circuit, for example, a microwave oscillator or the like.

Commonly, in an output circuit such as a microwave oscillator, etc., it is necessary to take out, i.e., pass through as the output of the circuit, only the oscillation output. For this purpose, referring to FIGS. 1(A) and 1(B), it has been a conventional practice to employ a DC cutting circuit in which a gap G is formed in the course of a micro-strip line L for effecting signal transmission from an input side circuit such as an oscillator or the like (not shown) to an output side circuit such as a mixer circuit, etc. (not shown), with a layer-built chip capacitor C being disposed thereat connecting the two sides of the gap G as shown in FIGS. 1(A) and 1(B). In FIGS. 1(A) and 1(B), a grounding electrode Eg is formed generally over the entire reverse surface of a substrate B made, for example, of alumina or the like, with the chip capacitor C being connected to the micro-strip line L by solder S as illustrated.

However, in the known DC cutting circuit as described above, there are such disadvantages that cost tends to be increased by the employment of the layer-built chip capacitor C, and that, since the capacitor C itself is not provided with a filter characteristic, it is possible for a signal not required such as a spurious signal, etc., to be undesirably transmitted. In addition, when the working frequency becomes high, for example, up to the order of 10 GHz, the influence due to parasitic inductance of the chip capacitor is increased, and it becomes doubtful whether or not its function as a capacitor is correctly performed, thus presenting a problem with respect to the effectiveness of the capacitor.

In some of the prior art DC cutting circuits, an attenuator of the $\pi$ type or the T type is inserted in series with the layer-built chip capacitor as referred to above in order to improve frequency stabiity against variation of load. However, an arrangement including such an attenuator requires extra procedures such as attaching a chip resistor or trimming a thick or thin film resistor for the formation of the attenuator, thus resulting in an increase in labor costs.

SUMMARY OF THE INVENTION

Accordingly, an essential object of the present invention is to provide an improved DC cutting circuit which is capable of preventing transmission of signals at undesired frequencies, and can be produced through simple processing at low cost without employment of a layer-built chip capacitor or the like.

Another important object of the present invention is to provide a DC cutting circuit of the above described type which is superior in frequency stability against variation of load even without adoption of an attenuator of the $\pi$ type or T type.

In accomplishing the above first object, according to one preferred embodiment of the present invention, there is provided a DC cutting circuit which includes (a) a resonator electrode having an electrical length of $\frac{1}{4}$ wavelength and formed at a forward open end of a strip line connected to input side circuitry, and (b) another resonator electrode having an electrical length of $\frac{1}{4}$ wavelength and formed at a forward open end of a strip line connected to output side circuitry, with the resonator electrodes being disposed in a parallel relation to each other so as to couple the input side circuitry with the output side circuitry by said two resonator electrodes.

Furthermore, in order to accomplish the above second object, in another aspect of the present invention, there is also provided a DC cutting circuit which includes (a) a resonator electrode having an electrical length of $\frac{1}{4}$ wavelength and formed at a forward open end of a strip line connected to input side circuitry and (b) another resonator electrode having an electrical length of $\frac{1}{4}$ wavelength and formed at a forward open end of a strip line connected to output side circuitry, with the resonator electrodes being disposed in a parallel relation to each other so as to couple the input side circuitry with the output side circuitry by said two resonator electrodes, and at least the one resonator electrode connected to the input side circuitry, of said two resonator electrodes, is terminated by a resistor member. Since the above two resonator electrodes are disposed in a parallel relation to each other without contacting, the desired DC cutting effect can be achieved. In this case, the two resonator electrodes constitute a band-pass filter having a characteristic which is determined by factors such as distances therebetween, impedance values of the respective resonator electrodes, etc. Accordingly, by properly setting the above factors, the desired frequency component may be transmitted to the output side with a small amount of attenuation with the undesirable frequency component being markedly attenuated.

BRIEF DESCRIPTION OF THE DRAWINGS

These and other objects and features of the present invention will become apparent from the following description of preferred embodiments thereof with reference to the accompanying drawings, in which.

DETAILED DESCRIPTION OF THE INVENTION

Figure 1A:
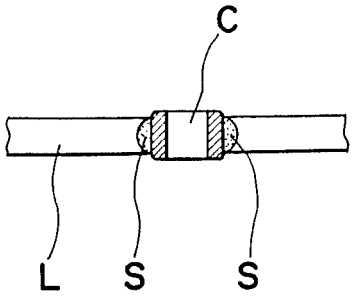
Fig. 1(A) PRIOR ART
FIG. 1(A) is a schematic top plan view partly in section, showing a conventional DC cutting circuit (already referred to)

Before the description of the present invention proceeds, it is to be noted that like parts are designated by like reference numerals throughout the accompanying drawings.

Figure 2:
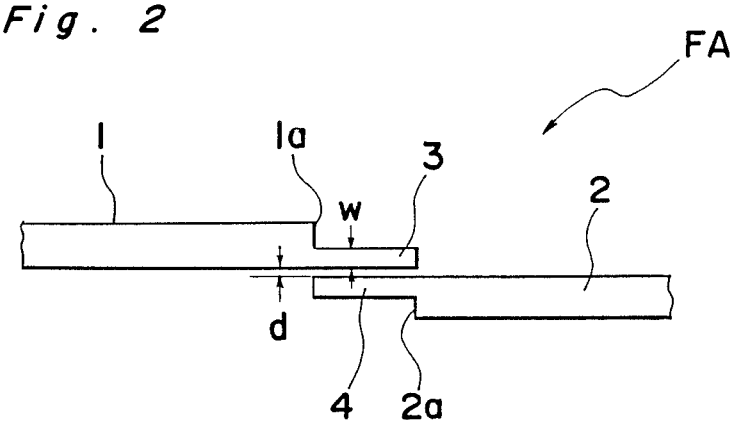
FIG. 2 is a schematic top plan view of an improved DC cutting circuit according to one preferred embodiment of the present invention.

Referring now to the drawings, there is shown in FIG. 2 an improved DC cutting circuit FA according to one preferred embodiment of the present invention.

In FIG. 2, the DC cutting circuit FA includes a resonator electrode 3 having an electricl length of $\frac{1}{4}$ wavelength and formed at a forward open end 1*a* of a micro-strip line 1 connected to an input side circuitry such as an oscillator or the like (not shown), and another resonator electrode 4 also having an electrical length of ¼ wavelength and formed at a forward open end *2a* of a micro-strip line 2 connected to an output side circuitry, e.g. a mixer circuit or the like (not shown). The resonator electrodes 3 and 4 are provided in a parallel relation to each other so as to couple the input side circuitry with the output side circuitry by said two resonator electrodes 3 and 4.

Figure 1B:
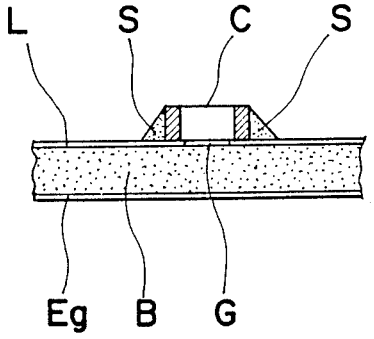
Fig. 1(B) PRIOR ART
FIG. 1(B) is a side cross-sectional view of the DC cutting circuit of FIG. 1(A) (already referred to)

These micro-strip lines 1 and 2 are respectively formed on the surface of a substrate (not shown here) of alumina or the like formed with a grounding electrode (not shown here) on its reverse surface in a similar manner to the conventional DC cutting circuit of FIG. 1(B).

The two resonator electrodes 3 and 4 disposed in the parallel relation as referred to above are constituted as a band-pass filter which is capable of transmitting the desired frequency component with a small amount of attenuation by properly setting each width w and a confronting distance d therebetween, etc. Each of such resonator electrodes 3 and 4 may be formed by trimming the respective forward end of the micro-strip line 1 or 2 by an amount to provide ¼ wavelength resonator electrodes.

Figure 3:
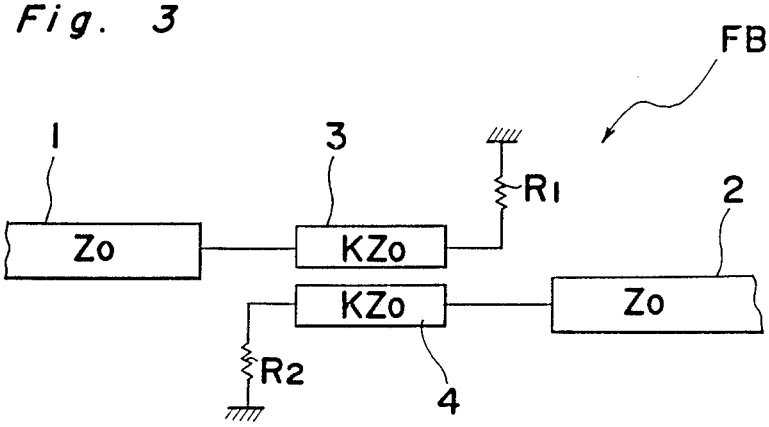
FIG. 3 is a diagram showing an equivalent circuit of a DC cutting circuit according to another embodiment of the present invention.

FIG. 3 is an equivalent circuit diagram schematically showing a DC cutting circuit FB according to another embodiment of the present invention. In FIG. 3, each of the micro-strip lines 1 and 2 has the characteristic impedance Zo, while each of the resonator electrodes 3 and 4 has the characteristic impedance KZo, in which K represents a positive real number. The resonator electrodes 3 and 4 are respectively terminated through resistors R1 and R2, and by connecting these resistors R1 and R2 respectively between the resonator electrodes 3 and 4 and ground as shown, the frequency stability against variation of load of the oscillator or the like may be improved. Accordingly, such resistors R1 and R2 perform the same function as the attenuator of $\pi$ type or T type as employed in the conventional DC cutting circuit. The resistance values of the respective resistors R1 and R2 are set to such values as required for the improvement of the frequency stability against variation of load. These resistors R1 and R2 may be formed, for example, as thick film or thin film resistances, but other chip type resistors can be employed for the purpose depending on necessity.

It should be noted here that in a case where the impedance when the input side is viewed from the output side circuit may be large, one resistor R2 of the two resistors R1 and R2 referred to above can be removed.

It is to be also noted that in the foregoing embodiments, although the two-stage filter is formed by the resonator electrodes 3 and 4, the number of stages is not limited to the above, but the present invention may be effected in more than three stages as well.

The DC cutting circuit according to the present invention having the construction as described so far has the following advantageous effects.

(1) Since the cutting of the DC component is effected by the set of the resonator electrodes instead of a layer-built chip capacitor, the circuit may be formed to be compact in size and at low cost.

(2) Owing to the fact that the set of the resonator electrodes constitutes a band-pass filter, only the desired frequency component may be selectively transmitted, thus making it possible to suppress undesired components such as spurious waves, etc.

(3) Since the constant for the filter is known from such factors as the width, confronting distance, length, etc. of the resonator electrodes, any undesirable influence due to parasitic inductance at high frequencies, as may occur in the conventional layer-built chip type capacitor, is almost eliminated.

(4) Moreover, for the improvement of the stability of the frequency against variation of load, only two resistors, or possibly one resistor, serve this purpose without employment of an attenuator of $\pi$ type or T type as in the conventional DC cutting circuit, and therefore, manufacturing of the circuit has been facilitated, with simultaneous reduction of labor cost.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A DC cutting circuit for passing a signal having a selected wavelength from input side circuitry to output side circuitry while cutting from said signal any DC component therein, which comprises a resonator electrode having an electrical length of ¼ wavelength at said selected wavelength and formed at a forward open end of a micro-strip line connected to said input side circuitry, and another resonator electrode also having an electrical length of ¼ wavelength at said selected wavelength and formed at a forward open end of a micro-strip line connected to said output side circuitry, said resonator electrodes being disposed in a parallel spaced relation to each other so as to couple said input side circuitry with said output side circuitry by said two resonator electrodes;

wherein at least the resonator electrode connected to the input side circuitry is terminated by a resistor member at said forward open end thereof.

2. A DC cutting circuit for passing a signal having a selected wavelength from input side circuitry to output side circuitry while cutting from said signal any DC component therein, which comprises a resonator electrode having an electrical length of ¼ wavelength at said selected wavelength and formed at a forward open end of a micro-strip line connected to said input side circuitry, and another resonator electrode also having an electrical length of ¼ wavelength at said selected wavelength and formed at a forward open end of a micro-strip line connected to said output side circuitry, said resonator electrodes being disposed in a parallel spaced relation to each other so as to couple said input side circuitry with said output side circuitry by said two resonator electrodes, both of said two resonator electrodes being terminated by respective resistor members at said forward open ends thereof.

3. A DC cutting circuit for passing a signal having a selected wavelength from input side circuitry to output side circuitry while cutting from said signal any DC component therein, said DC cutting circuit comprising a first micro-strip line for receiving said signal from said input side circuitry, and having a first resonator electrode at a forward open end thereof away from said input side circuitry, said first resonator electrode having an electrical length of ¼ of said selected wavelength, a second micro-strip line for passing said signal to said output side circuitry, and having a second resonator electrode at a forward open end thereof away from said output side circuitry, said second resonator electrode having an electrical length of $\frac{1}{4}$ of said selected wavelength, said first and second resonator electrodes being disposed parallel to each other and spaced so as to pass said signal of selected wavelength from said input side circuitry to said output side circuitry while cutting therefrom any said DC component;

wherein said first and second resonator electrodes are formed by providing portions of said first and second micro-strip lines at said forward open ends thereof, the dimensions of said portions being selected in accordance with said selected wavelength;

wherein said first and second resonator electrodes are spaced by a selected distance to pass said signal of selected wavelength; and wherein a first selected resistance is provided between said first resonator electrode and ground, at the end thereof away from said input side circuitry.

4. A DC cutting circuit as in claim 3, wherein a second selected resistance is provided between said second resonator electrode and ground, at the end thereof away from said output side circuitry.

* * * * *